United States Patent [19]

'T Hart

[11] 4,397,654

[45] Aug. 9, 1983

[54] COPPER CATALYST FOR FUELS

[75] Inventor: Rien 'T Hart, Rotterdam-Botlek, Netherlands

[73] Assignee: XRG International, Inc., Stuart, Fla.

[21] Appl. No.: 304,990

[22] PCT Filed: Nov. 17, 1980

[86] PCT No.: PCT/US80/01530

§ 371 Date: Sep. 4, 1981

§ 102(e) Date: Sep. 4, 1981

[87] PCT Pub. No.: WO82/01717

PCT Pub. Date: May 27, 1982

[51] Int. Cl.[3] ..... C10L 1/22

[52] U.S. Cl. ..... 44/53; 44/56; 44/57; 44/67; 44/72; 44/74; 44/68; 44/77

[58] Field of Search ..... 44/53,56, 57, 67, 72, 44/74, 77, 68

[56] References Cited

U.S. PATENT DOCUMENTS

| | | | |
|---|---|---|---|
| 1,271,114 | 7/1918 | Bachhaus | 44/56 |
| 1,622,572 | 3/1927 | Chandler | 44/56 |
| 4,073,626 | 2/1978 | Simmons | 44/57 |
| 4,099,930 | 7/1978 | Webb | 44/57 |
| 4,129,421 | 12/1978 | Webb | 44/57 |
| 4,145,190 | 3/1979 | Webb | 44/56 |
| 4,265,639 | 5/1981 | Scholtz | 44/57 |

*Primary Examiner*—Paul F. Shaver
*Assistant Examiner*—Y. Harris-Smith
*Attorney, Agent, or Firm*—John S. Roberts, Jr.

[57] ABSTRACT

This invention pertains to an improved energy-saving fuel additive for jet engines, gasoline and diesel engines, including additions to domestic heating and light industrial oils (#2 and #3) and residual or bunker fuel (#4, #5, and #6), which comprises as active ingredients a catalytic mixture of a major proportion of picric acid and a minor proportion of cupric sulfate.

| | |
|---|---|
| Cupric sulfate | .01-.03% |
| Picric acid | 1-2% |
| Methanol | 35-50% |
| Isopropyl alcohol | 15-5% |
| Toluene | 43-48% |
| Nitrobenzene | .6-1.0% |
| Primene 81R | .5-1.0% |

Additional variations include (1) the replacement of the toluene with about 10% methanol and 90% isopropyl alcohol for toxicity reasons and (2) replacement of the toluene with 10% methanol, 45% isopropyl alcohol, and 45% kerosene as a cost-reducing factor.

A preferred additive is:

| | |
|---|---|
| Cupric sulfate | .02% |
| Picric acid | 1.54% |
| Methanol | 35% |
| Isopropyl alcohol | 15% |
| Toluene | 48.3% |
| Nitrobenzene | .8% |
| Primene 81R | .05% |

9 Claims, No Drawings

COPPER CATALYST FOR FUELS

The present invention is an energy-saving fuel additive for gasoline and diesel engines which more particularly includes addition to domestic heating and light industrial oil (#2 and #3) and residual and bunker fuels (#4, #5, and #6). This fuel additive comprises as active ingredients a major proportion of picric acid and a minimum proportion of cupric sulfate ($CuSO_4$.no $H_2O$):

| | | |
|---|---|---|
| (I) | Cupric sulfate | .01-.03% |
| | Picric acid | 1-2% |
| | Methanol | 35-50% |
| | Isopropyl alcohol | 15-5% |
| | Toluene | 43-48% |
| | Nitrobenzene | .6-1.0% |
| | Primene 81R | .5-1.0% |

Additionally, cuprous sulfate may be utilized in lieu of cupric sulfate, although not preferred.

The basic additive has two variations which are included in the present invention. One variation replaces the toluene with a solvent ratio of preferred about 10% methanol and 90% isopropyl alcohol by weight.

| | | |
|---|---|---|
| (II) | Cupric sulfate | .01-.03% |
| | Picric acid | 1-2% |
| | Methanol | 35-50% |
| | Isopropyl alcohol | 15-5% |
| | Methanol/isopropyl alcohol 10/90 | 43-48% |
| | Nitrobenzene | .6-1.0% |
| | Primene 81R | .5-1.0% |

The methanol/isopropyl alcohol substitution may be varied up to 50/50. The purpose of the substitution for toluene lies in the lesser toxicity values.

A second alternative replaces toluene with about 10% methanol, 45% isopropyl alcohol, and 45% kerosene:

| | | |
|---|---|---|
| (III) | Cupric sulfate | .01-.03% |
| | Picric acid | 1-2% |
| | Methanol | 35-50% |
| | Isopropyl alcohol | 15-5% |
| | Methanol/isopropyl alcohol/kerosene 10/45/45 | 43-48% |
| | Nitrobenzene | .6-1.0% |
| | Primene 81R | .5-1.0% |

The methanol/isopropyl alcohol/kerosene substitution for toluene may be varied to about 25% methanol, 25% isopropyl alcohol, and 50% kerosene. This alternative which includes kerosene is for cost conservation.

The added developments which are related to this invention but not claimed in this application are as follows.

An additional product which is targeted towards high flash point in gasoline comprises:

| | | |
|---|---|---|
| (IV) | Green basic copper carbonate hydroxide, $Cu_2CO_3(OH)_2$ | 1-3% |
| | Picric acid | 1-2% |
| | Methyl isobutyl ketone (MIBK) | 3-7% |
| | N—butyl alcohol | 10-25% |
| | Kerosene | 65-74% |

-continued

| | | |
|---|---|---|
| | Nitrobenzene | .04-.12% |
| | Primene 81R | .02-.10% |

Additionally, related to the present compositions is a diesel high flash point formulation comprises:

| | | |
|---|---|---|
| (V) | Elemental iron | .01-.03% |
| | Picric acid | 1-2% |
| | Methyl isobutyl ketone (MIBK) | 4-6% |
| | N—butyl alcohol | 15-25% |
| | Kerosene | 70-74% |
| | Nitrobenzene | .05-1% |
| | Primene 81R | .05-1% |

PRIOR ART

Of primary interest relative to patent prior art are three patents of Dr. Harry M. Webb, assigned to XRG International, Inc. This group of patents; namely, U.S. Pat. Nos. 4,099,930; 4,129,421; and 4,145,190, utilizes ferrous sulfate in conjunction with picric acid and includes water in the solvent milieu. The present additives in the majority are based upon cupric sulfate in conjunction with picric acid in the absence of water. Another patent is U.S. Pat. No. 1,669,181.

Of primary interest in the present application and invention is the basic formulation which substitutes cupric sulfate for ferrous sulfate in the Webb prior art. It has been found that the present copper composition is more active and imparts more power to the fuel than the ferrous compositions previously used. The preferred components of additive I are:

| | |
|---|---|
| Cupric sulfate (no water) | .02% |
| Picric acid | 1.5% |
| Methanol | 35% |
| Isopropyl alcohol | 15% |
| Toluene | 48.3% |
| Nitrobenzene | .8% |
| Primene 81R | .5% |

The preferred components of additive II are the same as the preferred components of additive I but the toluene is replaced by a combination of 10% methanol and 90% isopropyl alcohol.

The preferred components of additive III are the same as the preferred components of additive I but the toluene is replaced by a combination of 10% methanol, 45% isopropyl alcohol, and 45% kerosene. All are percent by weight.

Related products which are included in this invention are compositions related to a high flash point gasoline which utilizes the following preferred components:

| | |
|---|---|
| Green basic copper carbonate hydroxide | 2% |
| Picric acid | 1.5% |
| Methyl isobutyl ketone (MIBK) | 5% |
| N—butyl alcohol | 20% |
| Kerosene | 71.3% |
| Nitrobenzene | .08% |
| Primene 81R | .05% |

Another high flash point diesel formulation utilizes the following preferred components:

| | |
|---|---|
| Elemental iron | .1% |
| Picric acid | 1.5% |
| Methyl isobutyl ketone (MIBK) | 5% |
| N—butyl alcohol | 20% |
| Kerosene | 73.2% |
| Nitrobenzene | .08% |
| Primene 81R | .05% |

THE INGREDIENTS

Copper Sulfate. The copper sulfate which is useful in this invention is cupric sulfate, preferably the dehydrated variety $CuSO_4$.no $H_2O$. Experiments have shown that the synergistic catalytic activity of this compound exceeds that of iron or ferrous sulfate previously used by a substantial degree.

Picric Acid. This trinitrophenol acts synergistically with the cuprous sulfate to give the active component of this invention.

The Aromatic Solvents. Preferably as aromatic solvent, toluene is utilized. Of the alkyl benzenes possible, toluene, ortho-, meta-, and para-xylenes are preferred and the mesitylenes are operable. In some of the applications herein the toluene is replaced with other less toxic solvents.

The Alcoholic Solvents. Of the lower alkanols useful in this invention methyl alcohol and isopropanol are preferred, although any $C_1$–$C_6$ lower alkanol straight- or branch-chain can be used. Of additional interest is normal butyl alcohol which is used in the formulation designed to give a high flash point.

Nitrobenzene. This compound is utilized as an additional solvent. It is miscible with alkanols and is a superior organic solvent for the picric acid.

Primene. Primenes are tertiary alkylamines which are a cross of primary aliphatic amines of the general formula $R_1(R_2)(R_3)CNH_2$ in which the amino group is linked to a tertiary carbon atom. The amines utilized in this invention are Primene 81R and Primene JM-T, with the 81R preferred. These amines are antioxidants and stabilizers for fuel oils and jet fuels.

EXAMPLE 1

Prior to testing, all vehicles had their catalytic converters removed. The test sequence began with a baseline Federal Test Procedure (FTP) and Highway Fuel Economy test (HFET). Next replicate FTP and HFET tests were performed to verify data repeatability. Following this the first additive was combined with the commercial unleaded fuel at a ratio of 1 ounce of additive for every 12 gallons of fuel. An FTP/HFET test series was performed and replicate tests followed immediately.

The catalytic converters were welded in position prior to the next test series. Baseline FTP and HFET tests were conducted and replicate baseline tests followed. The same additive used for testing without catalytic converters was then added at the same 12:1 ratio. FTP/HFET testing with additive was performed on all vehicles with replicate tests immediately thereafter.

The catalytic converters were again removed. Next each vehicle received 400 miles of mileage accumulation using the Automotive Environmental Systems, Inc. highway/city mileage accumulation driving schedule. The mileage accumulation was done with XRG additive in the commercial unleaded fuel. The additive used for the mileage accumulation and the tests following mileage accumulation was not the same additive used in the previous test series. All additives were unmarked. After mileage accumulation the vehicles received FTP/HFET series with replicate tests.

Between the baseline FTP/HFET and the mileage accumulation with the second additive, the vehicles incurred an average of 1672 miles. The Chevrolet Monte Carlo (#0051) had 1591 miles; the Ford LTD (#0052) had 1740 miles; and the Buick Regal (#0053) had 1686 miles. The miles were accumulated with and without catalytic converters, with commercial unleaded fuel and with commercial unleaded fuel with an additive.

Table 1 relates to cupric sulfate with the formulation of this invention designated additive I.

Table 2 relates to ferrous sulfate using the formula as noted in Webb U.S. Pat. No. 4,145,190, column 1.

TABLE 1

Cupric Sulfate
Fuel Economy Summary

| Vehicle No. | Test | Without Additive | With Additive | % Change |
|---|---|---|---|---|
| CX051 | FTP | 14.439 | 14.971 | +3.7 |
| | HFET | 18.933 | 19.760 | +4.4 |
| CX0052 | FTP | 13.724 | 14.669 | +6.9 |
| | HFET | 20.477 | 22.055 | +7.7 |
| CX0053 | FTP | 14.969 | 16.159 | +7.9 |
| | HFET | 19.281 | 21.185 | +9.9 |
| Fleet | FTP | 14.359 | 15.240 | +6.1 |
| | HFET | 19.542 | 20.957 | +7.2 |

TABLE 2

Ferrous Sulfate
Fuel Economy Summary

| Vehicle No. | Test | Without Additive | With Additive | % Change |
|---|---|---|---|---|
| CX0051 | FTP | 14.182 | 14.345 | +1.1 |
| | HFET | 19.125 | 19.380 | +1.3 |
| CX0052 | FTP | 14.088 | 14.999 | +6.5 |
| | HFET | 22.864 | 22.798 | −0.3 |
| CX0053 | FTP | 15.793 | 15.582 | −1.3 |
| | HFET | 20.554 | 19.852 | −3.4 |
| Fleet | FTP | 14.648 | 14.958 | +2.1 |
| | HFET | 20.736 | 20.571 | −0.8 |

I claim:

1. A fuel additive for jet, internal combustion, and diesel engines comprising an active ingredient formulation of a mixture of picric acid and cupric sulfate in a relationship of about 0.01 to 0.75–1.0 cupric sulfate to picric acid by weight percent in a mixed solvent of methanol, isopropyl alcohol, toluene, nitrobenzene, and a tertiary alkyl amine which is a cross of primary aliphatic amines of the general formula $R_1(R_2)(R_3)CNH_2$.

2. An additive comprising the following make up:

| | |
|---|---|
| Cupric sulfate | .01–.03% |
| Picric acid | 1–2% |
| Methanol | 35–50% |
| Isopropyl alcohol | 15–5% |
| Toluene | 43–48% |
| Nitrobenzene | .6–1.0% |
| Tertiary alkyl amine which is a cross of primary aliphatic amines of the general formula $R_1(R_2)(R_3)CNH_2$ | .5–1.0% |

3. The additive according to claim 2 wherein the cupric sulfate is utilized with a solvent of about 10% methanol and 90% isopropyl alcohol in place of toluene to lessen toxicity.

4. The additive according to claim 2 wherein a combination solvent of 10% methanol, 45% isopropyl alcohol, and 45% kerosene replaces the toluene.

5. A method of utilizing a fuel additive for jet, internal combustion, and diesel engines comprising an active ingredient formulation of a mixture of picric acid and cupric sulfate in a relationship of about 0.01 to 0.75–1.0 cupric sulfate to picric acid by weight percent in a mixed solvent of methanol, isopropyl alcohol, toluene, nitrobenzene, and a tertiary alkyl amine which is a cross of primary aliphatic amines of the general formula $R_1(R_2)(R_3)CNH_2$.

6. In a method for utilizing a fuel additive for jet, internal combustion, and diesel engines which compresses the step of utilizing an active ingredient formulation of a mixture of picric acid and cupric sulfate in a relationship of about 0.01 to 0.75–1.0 cupric sulfate to picric acid by weight percent in a mixed solvent of methanol, isopropyl alcohol, toluene, nitrobenzene, and a tertiary alkyl amine which is a cross of primary aliphatic amines of the general formula $R_1(R_2)(R_3)CNH_2$.

7. A method for utilizing an additive for jet, internal combustion, and diesel engines which comprises utilizing a composition as follows:

| | |
|---|---|
| Cupric sulfate | .01–.03% |
| Picric acid | 1–2% |
| Methanol | 35–50% |
| Isopropyl alcohol | 15–5% |
| Toluene | 43–48% |
| Nitrobenzene | .6–1.0% |
| Tertiary alkyl amine which is a cross of primary aliphatic amines of the general formula $R_1(R_2)(R_3)CNH_2$ | .5–1.0% |

8. The method according to claim 7 wherein the cupric sulfate is utilized with a solvent of about 10% methanol and 90% isopropyl alcohol in substitution of toluene and to lessen toxicity.

9. The method according to claim 7 wherein there is utilized a combination solvent of about 10% methanol, 45% isopropyl alcohol, and 45% kerosene in substitution of toluene.

* * * * *